US005762200A

United States Patent [19]

Goudreau

[11] Patent Number: 5,762,200

[45] Date of Patent: Jun. 9, 1998

[54] PRODUCT SUSPENSION PACKING

[75] Inventor: Rodney A. Goudreau, West Warren, Mass.

[73] Assignee: Eastern Container Companies, Springfield, Mass.

[21] Appl. No.: 895,010

[22] Filed: Jul. 16, 1997

[51] Int. Cl.[6] ..... B65D 85/30

[52] U.S. Cl. ..... 206/583; 206/594

[58] Field of Search ..... 206/583, 588, 206/591, 592, 593, 594, 701, 709, 721, 722, 724, 497, 461

[56] References Cited

U.S. PATENT DOCUMENTS

| | | | |
|---|---|---|---|
| 3,486,615 | 12/1969 | Woskin . | |
| 4,083,451 | 4/1978 | Hair . | |
| 4,574,951 | 3/1986 | Weaver . | |
| 4,852,743 | 8/1989 | Ridgeway . | |
| 4,923,065 | 5/1990 | Ridgeway . | |
| 4,979,611 | 12/1990 | Bolliger et al. . | |
| 5,071,009 | 12/1991 | Ridgeway . | |
| 5,109,980 | 5/1992 | Matsuoka et al. . | |
| 5,218,510 | 6/1993 | Bradford . | |
| 5,251,760 | 10/1993 | Smith et al. | 206/583 |
| 5,388,701 | 2/1995 | Ridgeway . | |
| 5,405,000 | 4/1995 | Hagedon et al. . | |
| 5,579,917 | 12/1996 | Lofgren et al. | 206/583 |

*Primary Examiner*—Jacob K. Ackun
*Attorney, Agent, or Firm*—Richard H. Kosakowski, Esq.; Holland & Bonzagni, P.C.

[57] ABSTRACT

A product suspension packaging device is described and includes a folder and a cradle, both formed from corrugated material. The folder is a unitary piece of corrugated, divided into two halves or frames. Each frame has a central opening therein. The two frames are separated by a cut line formed in the corrugated material. The entire piece of corrugated is encased in a heat-shrinkable, stretchable material. The article or product to be packaged is placed onto the stretchable material and the folder is folded in half, thereby completely enclosing the product between the two halves or frames of the folder. The folder may then be placed within the corrugated cradle, which serves to retain the folder within a corresponding corrugated shipping container or box.

20 Claims, 5 Drawing Sheets

PRODUCT SUSPENSION PACKING

RELATED APPLICATION

This application is based in part on Provisional patent application Ser. No. 60/037,787, filed Feb. 4, 1997.

BACKGROUND OF THE INVENTION

This invention relates to packaging concepts, and more particularly to a packaging structure that suspends and restrains the packaged article or product between several resilient membranes.

The prior art for packaging of fragile, non-fragile and/or static electricity-sensitive objects or articles is replete with varied and numerous structural arrangements and methods. All of these arrangements purport to adequately package the object to safely withstand normal shipping and handling hazards. Regardless of the structural arrangement or configuration chosen, any successful packaging scheme shares several desired relative features, including sturdiness, lightweight, low cost, recyclability, small number of components, the ability to withstand various different stress forces encountered or loads transmitted from the outer container during packing, shipping and handling, and the ability to satisfactorily function in various different physical environments (e.g., temperature, pressure, moisture, shock, vibration). In general, any successful packaging scheme should adequately protect the packaged article from all expected and unexpected shipping and handling hazards.

Examples of prior art packaging concepts include a complete or incomplete fill of packing material within a packing container (e.g., compounds such as foam pieces, tissue paper, deformable or crushable pads), expanding fill material (e.g., foam), specially-shaped molded or preformed restraints disposed inside the container, or preformed outer containers.

However, all of these packaging methods and structures typically suffer from one or more common drawbacks, including a relatively large number of pieces of required fill material, hard-to-recycle material, and the specially-shaped restraints or containers that are only usable for the specific item and which are generally unusable for other items of different size or shape.

It is also known in the prior art to utilize a packing scheme that suspends the article between a pair of pliable or deformable members, such as a heat-shrinkable film disposed over each half of a foldable corrugated panel, or over each one of two separate corrugated panels. Each corrugated panel typically has a hole formed in the approximate center of the panel. The heat-shrinkable film forms a planar web over the hole. When the panels are brought together, the article or product to be packaged stretches or deforms the webs of heat-shrinkable, stretchable material. The deformation is in the nature of an amount of stretching or deflection of the material from out of its normal planar orientation. This results in a holding force placed onto the product by the stretched material. Prior art examples of various suspension packaging schemes are given in U.S. Pat. Nos. 4852743, 4923065, 5071009, 5388701 and 5218510.

As discussed in detail in the aforementioned U.S. Pat. No. 5388701, a relatively simplistic product suspension packaging scheme (such as that disclosed in the aforementioned U.S. Pat. No. 4852743), involving two pieces of corrugated (either separate pieces or one piece which is foldable in half to form the two pieces), with each piece of corrugated having a central hole or opening form therein, and wherein each piece of corrugated has attached thereto a piece of stretchable material, has an inherent problem. This problem arises when a relatively thin product is suspended between only two opposing pieces of stretched material. The problem relates to the fact that the thin product displaces the stretchable material by only a relatively small amount from its normal planar orientation. This results in a relatively small amount of holding force being applied to the product by the stretched material. This could allow the product to shift or move with respect to the stretched material, causing damage to the product.

Therefore, it can be seen that the amount of holding force applied to the product by this stretchable material is proportional to the amount of deformation of the stretchable material (which is approximately proportional to the dimension of the product which deforms the stretchable material).

Other problems exist with the prior art suspension packaging scheme described in U.S. Pat. No. 4852743. That patent teaches the use of two separate pieces of corrugated. Each piece of corrugated has a centrally-located hole or opening formed therein. However, only one side of each piece of corrugated is covered with a stretchable material. The material is attached by glue or other means to the piece of corrugated material.

One problem is that the material may eventually become detached from the corrugated. A second problem is that the single piece of material provides only one layer of deformable material per piece of corrugated. Instead, if the stretchable material was such that it completely encased or enclosed the piece of corrugated, then there would exist two layers of deformable or stretchable material per piece of corrugated. Another problem is that the glue renders the package unrecyclable.

Yet another problem occurs when it is attempted to package a product that is thicker than the total thickness of the two pieces of corrugated folded together. The result is that the product exceeds this total thickness dimension and protrudes beyond the outer surfaces of the folder. In this situation, the packaged product is susceptible to damage. Also, the protruding product could prevent the folder from being inserted into an outer box.

The aforementioned U.S. Pat. No. 5218510 teaches the use of a stretchable material that completely encases or encloses a piece of corrugated, thereby forming two parallel-disposed layers of deformable or stretchable material per piece of corrugated. However, that patent also teaches the use of a relatively thick piece of corrugated, which results in only two out of the four layers of stretchable material being deformed by the product to be packaged. Also, that patent could be limited by the protruding product problem discussed above with respect to U.S. Pat. No. 4852743.

Accordingly, it is a primary object of the present invention to provide a means for packaging an article such that the article is sandwiched between four or more pliable and resilient membranes.

It is a general object of the present invention to provide a universal and reusable means for packaging fragile, delicate, static electricity-sensitive, or specially-shaped articles.

It is another object of the present invention to provide the packaging means wherein the resilient membranes are transparent, thereby allowing the device or article to be viewed for inspection without disassembly of the packaging means.

Still another object of the present invention is to provide the packaging means with resilient membranes comprising anti-static material, to thereby allow for packaging of static-sensitive electronic devices while eliminating the need for a separate, additional electrostatic dissipative bag for the packaged article.

Yet another object of the present invention is to provide the packaging means which includes a rigid folder completely surrounded by a resilient membrane that is not attached to the folder, thereby eliminating problems with prior art packaging schemes where the resilient membrane is attached by glue or other means to a rigid member, such as a piece of corrugated.

Still another object of the present invention is to provide the packaging means in a form which reduces the amount of undesired movement or slippage of the packaged article with respect to the resilient membranes.

It is another object of the present invention to provide the packaging means with the resilient membrane completely encasing the rigid folder, thereby allowing the folder to be utilized in "clean rooms" where sensitive electronic devices are handled.

Yet another object of the present invention is to have the packaging means comprise material in an arrangement and without the use of glues that is relatively easy to recycle.

It is another object of the present invention to provide a means for packaging an article by suspension of the article, wherein the packaging means is in contact with the article but is not attached to the article.

Another object of the present invention is to provide a packaging means that relatively limits the magnitude of shipping forces or loads transmitted to the packaged article.

It is another object of the present invention to provide a universal packing means that accommodates articles of various sizes and shapes.

It is still another object of the present invention to provide a packaging means which protects the packaged article from dust or other contaminants.

Yet another object of the present invention is to provide a packaging means that restrains the article within a predetermined location within the packaging means.

Still another object of the present invention is to provide a packaging means that increases an amount of restraining force that it applies to the packaged article as the article moves away from its predetermined location within the packaging means.

The above and other objects and advantages of the present invention will become more readily apparent when the following description is read in conjunction with the accompanying drawings.

SUMMARY OF THE INVENTION

To overcome the deficiencies of the prior art and to achieve the objects listed above, the Applicant has invented an article of manufacture and corresponding method for suspension packaging of products of various sizes and shapes.

According to a preferred embodiment of a first, broadest aspect of the invention, a folder is provided which comprises a unitary piece of corrugated divided into two halves or frames. Each frame has a corresponding central opening therein. The two frames are separated at a centrally-located cut line formed in the corrugated material. At each outer end of the cut line is formed a hinged score. Each hinged score is identical. The hinged score comprises a pair of vertical fold lines formed in the corrugated material, together with a horizontal cut line in which the corrugated material is cut entirely through. Continuously enclosing the entire folder is clear, stretchable, heat-shrinkable elastic or pliable material that is shrink-wrapped for a snug fit over the entire folder. This results in a pair of parallel layers of the pliable material enclosing the entire folder.

In use, the article or product to be packaged is placed onto the pliable membrane material within an opening in one of the pieces of corrugated. The other piece of corrugated is then folded over, thereby enclosing the article or product between the two pieces of corrugated and four layers of pliable material.

In an alternative embodiment of the first aspect of the present invention, instead of just a square or rectangular opening formed in each piece of corrugated, the opening has four separate, hinged, triangular-shaped protrusions protruding into the opening. Each protrusion connects with the corrugated frame material by a "hinge" comprising a corresponding perforated score line. Each protrusion also has a corresponding upper portion that connects with the main portion of the protrusion by a corresponding perforated score line.

In operation of this alternative embodiment, when the article or product to be packaged is sandwiched between two frames or pieces of corrugated, the protrusions serve to better retain the article or product approximately within the center of the corresponding opening in each piece of corrugated. This is accomplished by the protrusions, which limit the amount of the extension or deformation of the pliable material. Specifically, any movement of the packaged article with respect to the membranes causes the article to push back on the protrusions. However, since the protrusions are "sandwiched" between the layers of film, the protrusions are limited in an amount of travel. The protrusions thus limit an amount of force that the article or product is able to put onto the protrusions and pliable membranes. They also limit the amount of movement or "slippage" of the product within the folder. Essentially, the greater the amount of movement of the article away from the approximate center of the openings in the folder, the greater the amount of retention force placed onto the article by the protrusions.

According to a second aspect of the present invention, a corrugated cradle is provided which comprises a unitary piece of corrugated material formed with a number of predetermined openings and fold lines. The cradle comprises a center portion flanked by a pair of first adjacent sections connected therewith by corresponding fold lines. Each of the first adjacent sections has a rectangular cut out portion. Next to these first adjacent sections are formed a second pair of adjacent sections, connected thereto by corresponding fold lines. Each of these sections has a circular hole formed therein. Finally, connected to these sections by fold lines is a pair of tab sections. The cradle is designed to "wrap around" the folder and hold the folder in a "sandwiched" position, after the article or product to be packaged has been placed within the folder and the folder has been folded in half to constrain the article or product therewithin.

More specifically, when the folder and cradle are assembled together, the bottom edge of the center cut line of the folder rests on the center section of the cradle. The rectangular openings in the first adjacent side panels of the cradle allow each frame to pass therethrough. Once having done so, the remaining side panels of the cradle are then folded over towards the center of the folder. Finally, the tab sections of the cradle are folded over such that each frame of the folder sits between the corresponding opening or spacing between the corresponding pair of tab sections. The resulting packaging device of the present invention can then be inserted into a corresponding corrugated box. The box may be of a specific size such that it can only accomodate one folder and one cradle. In the alternative, the box may be sized large enough so that a plurality of folder/cradle configurations can fit snugly therewithin. In any event, the cradle is thicker than the folder, which allows for the packaging of articles that are greater in thickness than the folder and, perhaps, even greater in thickness than the cradle.

DETAILED DESCRIPTION OF THE PREFERRED EMBODIMENTS

Figure 1:
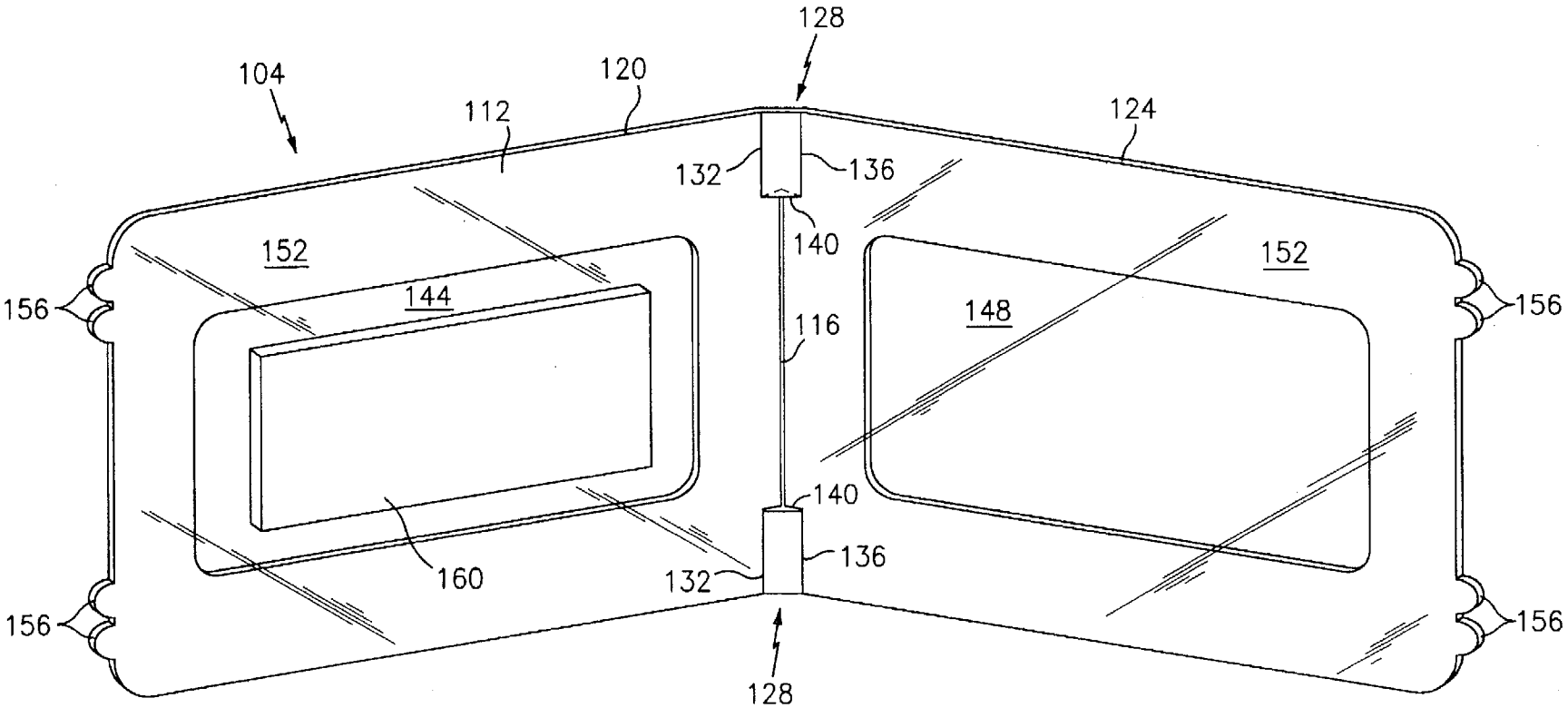
FIG. 1 is a perspective view of a folder component of the package of the present invention shown in an unfolded condition, together with an article or object to be packaged thereby.

Referring to the drawings in detail, a preferred exemplary embodiment of the package 100 of the present invention, comprising a folder 104 and a cradle 108, is illustrated therein. Referring specifically to FIG. 1, there illustrated is the broadest aspect of the present invention, which comprises only the folder 104. In a preferred embodiment, the folder 104 may comprise a single piece of double-walled, fluted corrugated material 112, or other suitable material. The folder 104 is foldable in half at a centrally-located cut line 116 formed in the corrugated material 112. The cut line 116 thus delineates two frames or halves 120, 124 of the folder 104.

At each outer end of the cut line 116 is formed a hinged score 128. Each hinged score 128 is identical. The hinged score 128 comprises a pair of vertical fold lines 132, 136 formed in the corrugated material 112, together with a horizontal cut line 140 at which the corrugated material 112 is cut entirely through. The centrally-located cut line 116, together with the two hinged scores 128, facilitate the folding of the folder 104.

Each frame 120, 124 has a centrally-located, rectangular-shaped opening 144, 148 formed therein. Continuously enclosing the entire folder 104 is clear, stretchable, heat-shrinkable elastic or pliable material 152. This material 152 is shrink-wrapped over the folder 104, thereby providing for a snug fit of the pliable material 152 over the entire folder 104. The pliable material 152 may comprise, for example, a resilient laminate, woven fabric, netting or puncturable elastomeric film.

Formed on the outer most edges of the left and right sides of the folder 104 (as viewed in FIG. 1) are four locator knubs 156, grouped in pairs. The purpose of these locator knubs 156 is to facilitate the assembly of the folder 104 to the cradle 108 of the present invention, as discussed in detail hereinafter.

FIG. 1 illustrates the folder 104 of the present invention in an unfolded condition. A rectangular-shaped article or object 160 to be packaged (e.g., an electronic device) is also illustrated as resting on the pliable membrane layer of film material 152 located on the inside surface of the left frame 120, as viewed in FIG. 1, at the opening 144 formed in the frame 120.

Figure 2:
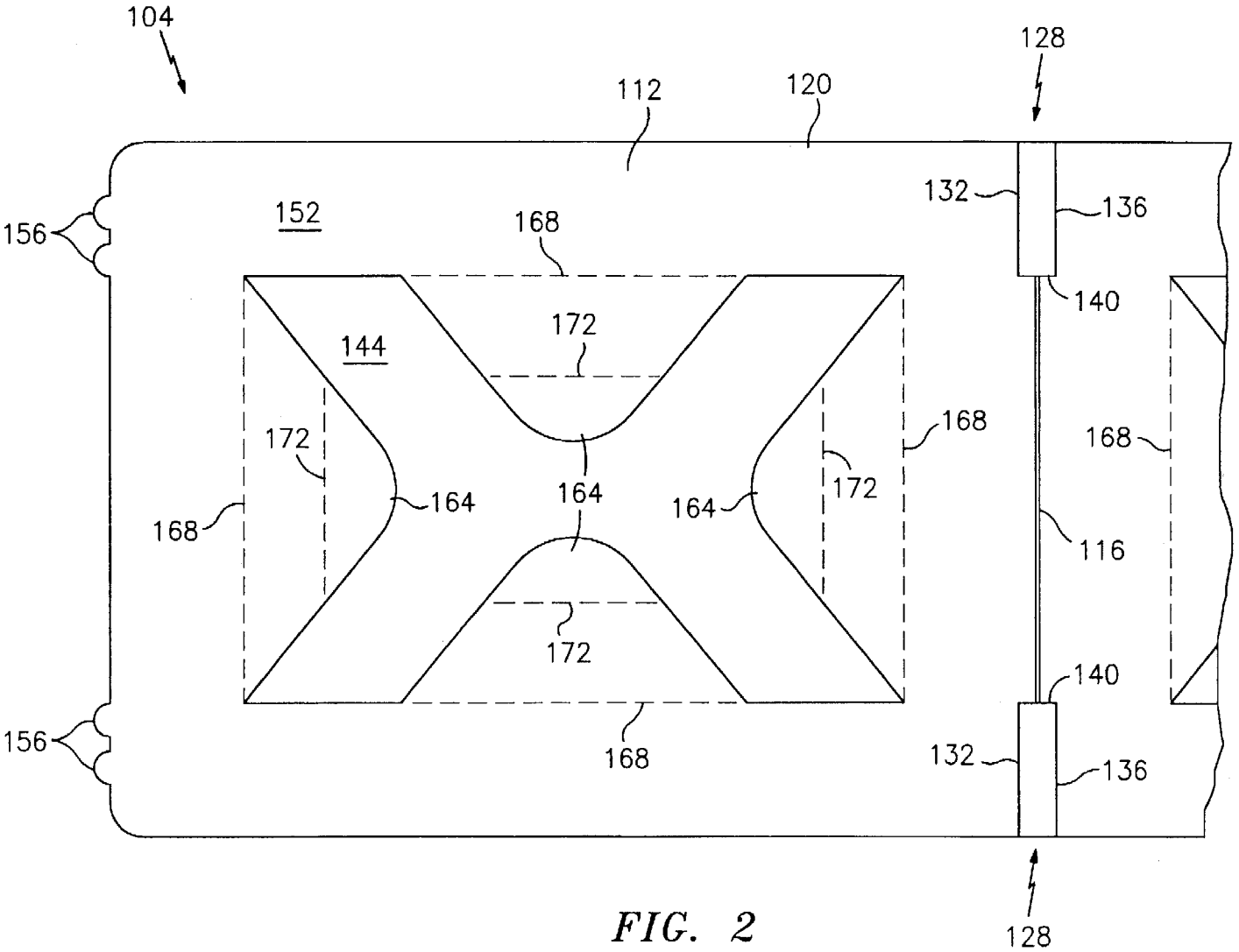
FIG. 2 is an alternative embodiment of the folder of FIG. 1.

Referring now to FIG. 2, there illustrated is an alternative embodiment of the folder 104 of the present invention. The folder 104 of FIG. 2 is similar in all respects to that illustrated in FIG. 1, with the exception that the rectangular-shaped opening 144, 148, formed in each frame 120, 124, now has formed therein four triangular-shaped protrusions 164. Each protrusion 164 is oriented such that it points towards the center of the opening 144, 148. Also, each protrusion 164 is "hinged" to the remainder of the corrugated material 112 comprising the folder 104 in that each protrusion 164 is connected with the folder material 112, at the perimeter of the opening 144, 148 formed in the folder material 112, by a corresponding perforated score line 168. Further, each protrusion 164 has an additional perforated score line 172 formed therein, approximately one-half way "up" the protrusion 164 toward the outer most point or tip of the protrusion 164.

The purpose of the protrusions 164 is described in detail hereinafter. However, it suffices that the protrusions 164 limit the amount of the deformation force applied onto the pliable material 152 by the article or object 160 to be packaged. The protrusions 164 also limit the amount of movement of the object 160 on the material 152, thereby restraining the article 160 from undesired movement.

Figure 3:
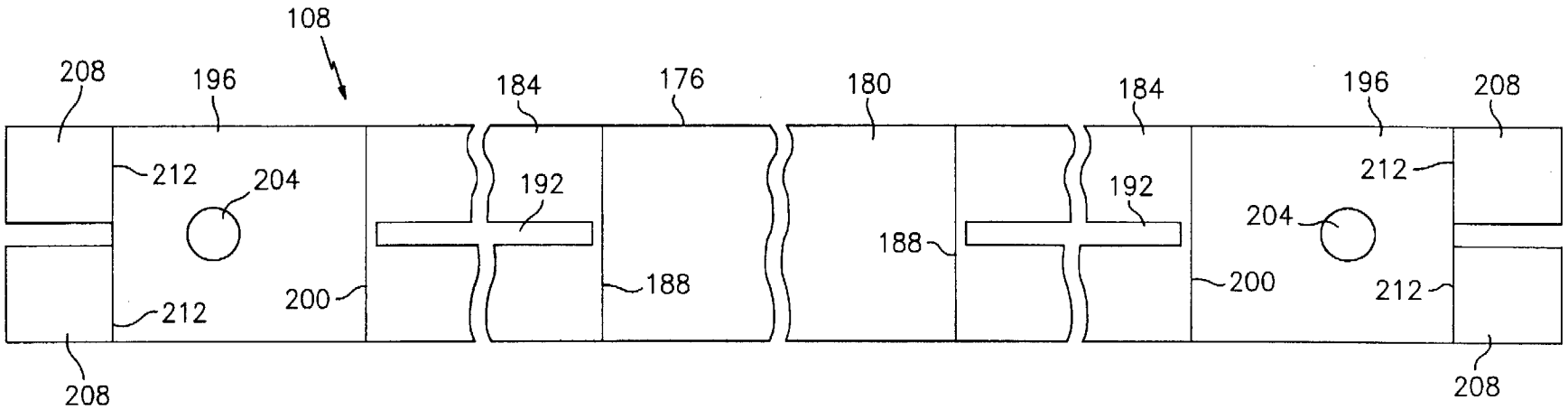
FIG. 3 is a plan view of a cradle component of the package of the present invention shown in an unfolded condition.

Referring now to FIG. 3, there illustrated, in plan view, is the cradle 108 component of the package 100 of the present invention. The cradle 108 is separate from the folder 104 described hereinbefore with respect to FIGS. I and 2. Similar to the folder 104, the cradle 108 may comprise a unitary piece of double or single-walled, fluted corrugated material 176. However, this is purely exemplary. Other rigid materials (such as cardboard or plastic) may be utilized for both the folder 104 and the cradle 108, within the broadest scope of the present invention.

Figure 6:
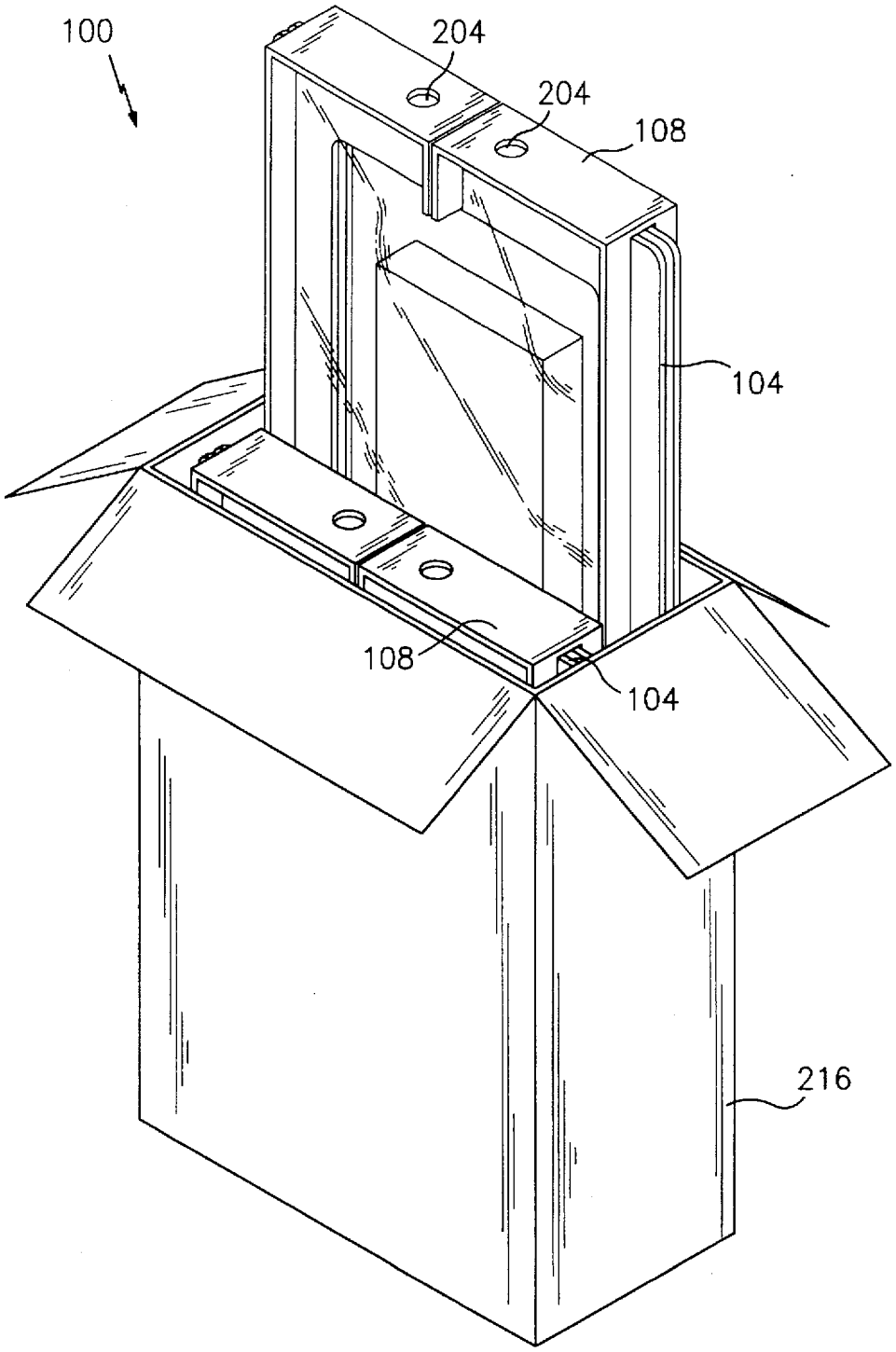
FIG. 6 is a perspective view of two of the folder/cradle arrangements of FIG. 4 within an outer container or box.

The corrugated material 176 of the cradle 108 is formed with a number of predetermined openings and fold lines. The cradle 108 comprises a center portion 180 flanked on each side by a pair of first adjacent sections 184, which are connected with the center section 180 by corresponding fold lines 188. Each of these first adjacent sections or panels 184 has a rectangular section 192 cut out therefrom. Next to these first adjacent sections 184 are formed a second pair of sections 196, which are connected with the first adjacent sections 184 by corresponding fold lines 200. Each of these second adjacent sections 196 has a circular hole 204 formed therein. These holes 204 serve as finger holes to facilitate the removal of an assembled folder 104 and cradle 108 arrangement from a box (FIG. 6). Finally, connected to each of these second adjacent sections 196 is a pair of tab sections 208 connected by corresponding fold lines 212. The two tab sections 208, at each end of the cradle 108, are separated by a space.

Figure 4:
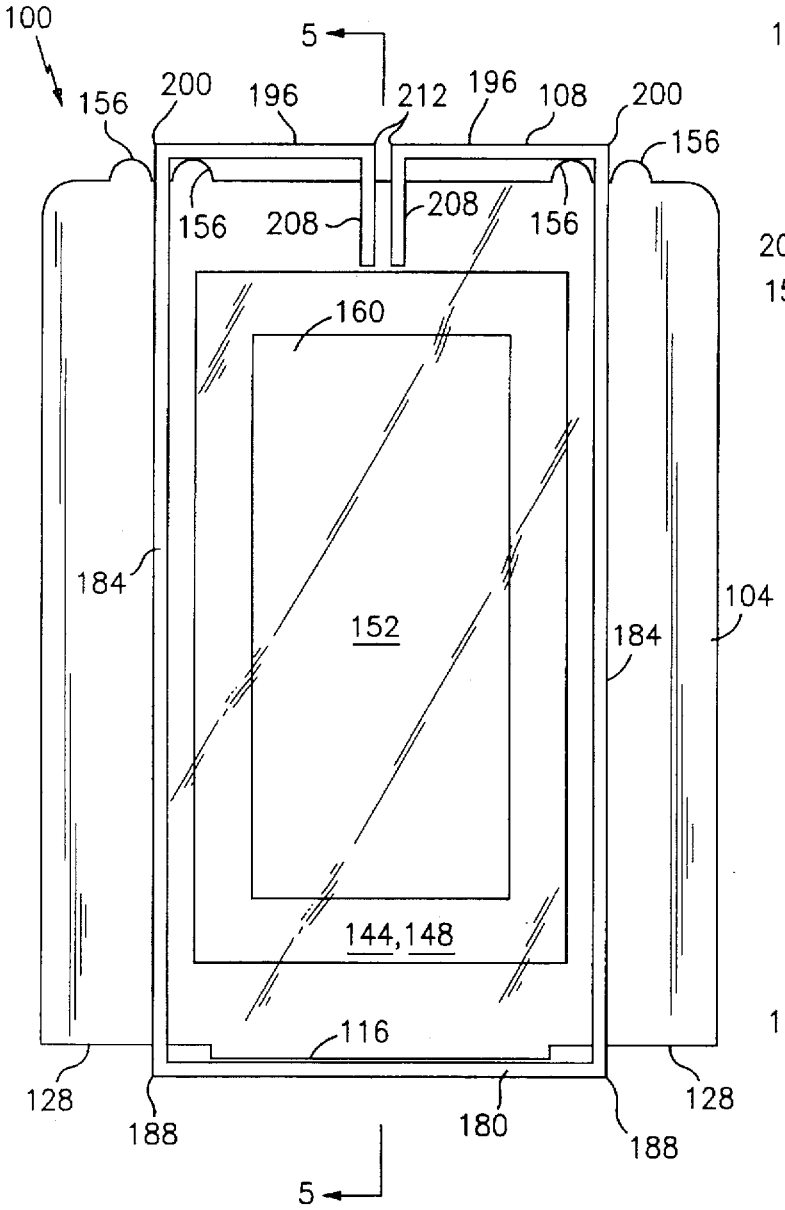
FIG. 4 is a plan view of the folder of FIG. 1 and the cradle of FIG. 3 assembled together, and including the article or object of FIG. 1 to be packaged.
Figure 5:
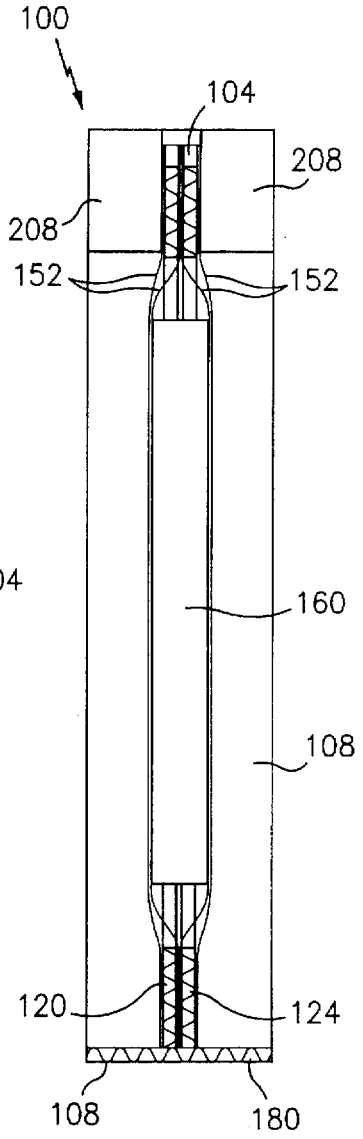
FIG. 5 is a cross-sectional view of the folder and cradle arrangement of FIG. 4, taken along the lines 5—5 of FIG. 4.

Referring now to FIGS. 4 and 5, there illustrated are the folder 104 and cradle 108 components of the present invention assembled together, thereby packaging, by the concepts of suspension and retention, the article or device 160. When assembling the folder 104 and cradle 108 with the articles 160 to be packaged, that article 160 is placed onto the pliable membrane 152 approximately within the center of the opening 144, 148 formed in either the left or right frame 120, 124, respectively of the folder 104, as illustrated in FIG. 1. Such placement of the article 160 to be packaged is also applicable to the alternative embodiment of the folder opening, illustrated in FIG. 2. The opening 144, 148 in each frame 120, 124 is generally larger than the article 160 to be packaged. Once the article 160 to be packaged is placed onto the film 152, the folder 104 is folded over along the centrally-located cut line 116. This forms a "sandwich", with the article 160 to be packaged being suspended between the four layers of pliable material 152 (two layers of material 152 per frame 120, 124 of the folder 104; one layer on the inside surface of the frame, another layer on the outside surface of the frame), which is better illustrated in the cross-sectional view of FIG. 5.

Once the folder 104 has been folded as such, the centrally-located cut line 116 of the folder 104 is placed onto the center section 180 of the cradle 108, as illustrated in FIG. 4. The cradle 108 is then folded over such that the rectangular-shaped opening 192, formed in each of the first adjacent sections 184 of the cradle 108, allows the folder material 112 to pass therethrough, also as illustrated in FIG. 4.

Next, the second adjacent sections 196 of the cradle 108 (i.e., those containing the finger hole 204) are folded over at a ninety-degree angle with respect to the first adjacent sections 184, as illustrated in FIG. 4. Finally, the outer tab sections 208 are folded down.

The sizing and physical dimensions of the cradle 108 and folder 104 are chosen such that the first adjacent sections 184 of the cradle 108 are located between the two locator knubs 156 formed in the folder 104, as illustrated in FIG. 4. The knubs 156 act to restrain movement of the cradle 108. Finally, with respect to FIG. 6, one or more of these assembled folder/cradle arrangements may be inserted within a corresponding outer container or box 216. However, the folder/cradle arrangement does not have to be utilized within an outer container.

Referring again to FIG. 5, there illustrated is the resulting deformation of the four layers of pliable material 152 by the article 160 packaged by sandwiching the article 160 between the four layers of pliable material 152. FIG. 5 illustrates the folder 104 of FIG. 4 without the protrusions 164 formed in the two openings 144, 148 of the folder 104. Nevertheless, the thickness of the corrugated material 112 comprising the folder 104 is typically chosen such that it is both thick enough to withstand normal shipping and handling hazards, yet is thin enough such that most articles or objects 160 to be packaged will deform all four layers of the pliable material 152 upon sandwiching of the object therebetween. This is in contrast to prior art suspension packaging schemes, as discussed hereinabove, wherein an article or object to be packaged will only deform the inner most two layers of pliable material. If the strength of the folder material 112 is an issue because it is too thin, then the cradle material 176 may be increased in size and/or strength to compensate. Theoretically, by deforming all four layers of pliable material 152, a greater holding force is provided onto the article 160 by such pliable material. For clarity, the corrugated material 112 comprising the folder 104 is illustrated in FIG. 5 as comprising single-walled, fluted corrugated material.

Also, the thickness of the article 160 can be greater than the thickness of the folder 104 when in the folded condition. This is because the thickness of the cradle 108 is greater than the thickness of the folder 104. However, if the folder/cradle arrangement is not to be used with an outer container or box 216, then the thickness of the article 160 may be greater than the thickness of the cradle 108.

If the alternative embodiment of the folder 104, illustrated in FIG. 2, is employed, then the four protrusions 164 serve to better retain the article 160 approximately within the two openings 144, 148 of the folder. This is accomplished by the additional force that the protrusions 164 will provide to the article 160 upon sandwiching of the object within the folder. More specifically, the four protrusions 164 are disposed or "sandwiched" between the two parallel-oriented layers of pliable material 152. When the object 160 is sandwiched between the two frames 120, 124 of the folder 104, that object 160 provides a force against not only the two parallel layers of pliable material 152 disposed or encasing each frame 120, 124 of the folder 104, but also it provides a force against the corrugated protrusions 164. The protrusions 164 are such that they serve to provide a greater holding force onto the article or object 160 than would be capable with just the two layers of pliable material 152. Specifically, the protrusions better serve to restrain the article or object from moving within the openings 144, 148. If the product 160 moves within the folder 104, it pushes back on the protrusions 164. But, because the protrusions 164 are sandwiched between two layers of film 152, the protrusions are constrained in an amount of movement, thereby keeping the article 160 within the openings 144, 148. Empirically it has been discovered that it is nearly impossible for the article 160 to move in an amount to reach the edges of the openings 144, 148.

The folder 104 of the broadest aspect of the present invention has been described and illustrated herein as comprising a single piece of corrugated material 112 that is foldable in half to create a "sandwich" for the article 160 to be packaged. However, it is to be understood that this is purely exemplary. Instead, the folder 104 may comprise two separate pieces of stiff or rigid material 112, resulting in two separate frames 120, 124. If such a separate frame arrangement is chosen, the cradle 108 serves as a means to keep the two frames in the sandwiched position.

Further, the folder 104 has been described as comprising a planar piece of corrugated material 112. However, this is purely exemplary. Other shapes for the folder 104 may be utilized within the broadest scope of the present invention, in light of the teachings herein. Nevertheless, such a planar shape of the folder 104 results in a pair of pliable material membranes 152, arranged in a parallel orientation, being formed on each side or surface of the planar folder 104. When a product or article 160 to be packaged is placed on to the pliable membranes 152, the product 160 distorts the planar membranes 152 from out of their normal planar orientation.

The universal package 100 of the present invention has been described herein for use in packaging a single article 160. However, it is to be understood that multiple items or objects 160 may be held between the layers of pliable material 152, without the use of separators or other devices, as long as sufficient space is available between the products 160 and within the frame openings 144, 148. Generally, it is not advisable to place an article 160 on the pliable material 152 and not within the openings 144, 148 within each frame 120, 124.

The film material 152 has been described and illustrated herein as comprising a clear or transparent material. However, this is purely exemplary. The film material 152 may comprise, if desired, an opaque material. However, if a transparent material is utilized, then inspections of the packaged article 160 are simplified, and aesthetic appeal to the customer can be maintained. Also, the film material 152 may comprise well-known and commercially-available electrostatic discharge protective film. The use of such film 152 protects an electrostatic-sensitive product, such as computer components, from the risk of electrostatic discharge, which could cause damage to the product 160. The use of such an electrostatic discharge protective film eliminates the prior art usage of a separate electrostatic discharge bag. However, the film 152 may comprise a material that has no electrostatic discharge protective properties.

Further, the film material 152 may be puncturable in the sense that if the film is accidentally or otherwise punctured (for example, by a sharp point on the product 160 to be packaged), then the film may be such that the structural integrity of it is not compromised. The film material 152, as punctured, may even further limit loads transmitted to the product at the sharp protrusion on the product 160.

The use of two layers of film 152 covering each frame 120, 124 is further beneficial if the article 160 punctures only the inner layer. A non-punctured outer layer is still available to suspend and restrain the article 160. On the other hand, if neither layer of the film material 152 is punctured, then the sharp points on the product 160 will cause the material 152 to stretch more at these points, which further distributes the load transmitted to the product 160. In any event, large transient drop and/or shock loads to the fragile product are limited by the trampoline-like action of the film material 152 in one direction, and friction resistance/deformation and ultimate movement of the product 160 between the pliable membrane layers in other directions, at least until the product 160 moves to contact and adjacent product 160 or edge of the frames 120, 124, or the protrusions 164.

It should be understood by those skilled in the art that obvious structural modifications can be made without departing from the scope of the invention. Accordingly, reference should be made primarily to the accompanying claims, rather than the foregoing specification, to determine the scope of the invention.

Having thus described the invention, what is claimed is:

1. A package, comprising a folder having a first frame and a second frame, each frame having an inside surface and an outside surface, each frame having an opening formed therein, the folder having a film material enclosing each frame thereby covering the opening in each frame, wherein the film is disposed in a single layer in an abutting and unattached manner adjacent to each surface of the folder, wherein when it is desired to constrain an article within a package the article is sandwiched between the layers of film material associated with the inside surfaces of both frames, each frame being of a predetermined thickness such that the article stretches both the layer of film material associated with the inside surface of each frame and a layer of film material associated with the outside surface of each frame, the film material comprising means for retaining the article between at least four stretched layers of the film material.

2. The package of claim 1, wherein the folder comprises the unitary piece of material.

3. The package of claim 2, wherein the first and second frames are connected by a cut line.

4. The package of claim 3, wherein the cut line connecting the first and second frames includes at least one hinged score comprising at least two fold lines connected with a cut line.

5. The package of claim 1, wherein each of the first and second frames comprises a separate unitary piece of material, each of the first and second frames being separately enclosed by film material.

6. The package of claim 1, wherein the film material is transparent at least at that portion of the film material proximate the opening in each frame.

7. The package of claim 1, wherein the film material is stretchable.

8. The package of claim 1, wherein the film material is heat-shrinkable.

9. The package of claim 1, wherein the film material is electrostatic discharge protective.

10. The package of claim 1, wherein at least one frame has at least one protrusion integrally connected therewith and extending into the opening of the frame, each one of the at least one protrusions comprising means for constraining the article from movement by reducing an amount of stretching of the corresponding stretched layers of the film material.

11. The package of claim 1, wherein the protrusion is integrally connected with the frame by a perforated score line.

12. The package of claim 10, wherein the protrusion has at least one foldable surface interruption formed along a length of the protrusion.

13. The package of claim 1, further comprising cradle means for holding the first and second frames in a sandwiched position relative to each other.

14. The package of claim 13, wherein the cradle means comprises a unitary piece of material that is foldable at predetermined locations.

15. The package of claim 14, wherein the unitary piece of material has at least one opening formed therein, the folder being inserted in the opening and held in the sandwiched position thereat.

16. The package of claim 13, wherein the folder further comprises locator knub means for holding the cradle means in a predetermined position with respect to the folder.

17. A package, comprising:

a folder having a first frame and second frame, each frame having an opening formed therein, each frame being enclosed by a film material, wherein when it is desired to constrain an article within the package, the article is sandwiched between the film material associated with each frame; and cradle means for holding the first and second frames in a sandwiched position relative to each other.

18. The package of claim 17, wherein each frame is of a predetermined thickness such that the article stretches the film material in a corresponding amount, the film material comprising means for retaining the article between the stretched film material.

19. The package of claim 17, wherein the cradle means comprises a unitary piece of material that is foldable at predetermined locations.

20. The package of claim 17, wherein the folder comprises a unitary piece of material, and wherein the first and second frames are connected by a cut line.

* * * * *

UNITED STATES PATENT AND TRADEMARK OFFICE

CERTIFICATE OF CORRECTION

PATENT NO. : 5,762,200
DATED : June 9, 1998
INVENTOR(S) : RODNEY A. GOUDREAU

It is certified that error appears in the above-indentified patent and that said Letters Patent is hereby corrected as shown below:

On the title page, Item [54] and Col. 1, line 1
In the Title, change "PACKING" to --PACKAGING--.

Column 6, line 35, change "FIGS. I and 2" to --FIGS. 1 and 2--.

Signed and Sealed this

First Day of September, 1998

*Attest:*

*Attesting Officer*

Bruce Lehman

BRUCE LEHMAN

*Commissioner of Patents and Trademarks*